US005687467A

United States Patent [19]

Bergmann et al.

[11] Patent Number: 5,687,467

[45] Date of Patent: Nov. 18, 1997

[54] METHOD FOR PREPARING AN ORTHOTIC APPLIANCE

[75] Inventors: John Bergmann, Evanston, Ill.; David Parker, Orem, Utah; Tom Sawyer, Winnetka, Ill.

[73] Assignee: Bergmann Orthotic Lab, Inc., Northfield, Ill.

[21] Appl. No.: 347,579

[22] Filed: Nov. 30, 1994

[51] Int. Cl.[6] ..... B23Q 17/00

[52] U.S. Cl. ..... 29/407.05; 29/424; 29/557; 12/146 M

[58] Field of Search ..... 29/407.01, 407.04, 29/407.05, 424, 557; 12/146 M, 142 N

[56] References Cited

U.S. PATENT DOCUMENTS

| | | | |
|---|---|---|---|
| 1,044,171 | 11/1912 | Guiliford | 12/146 M |
| 2,230,143 | 1/1941 | Hyland . | |
| 2,323,539 | 7/1943 | Hyland et al. . | |
| 2,440,508 | 4/1948 | Gould | 12/146 M |
| 4,449,264 | 5/1984 | Schwartz . | |
| 4,454,618 | 6/1984 | Curchod . | |
| 4,510,636 | 4/1985 | Phillips . | |
| 4,517,696 | 5/1985 | Schartz . | |
| 4,520,581 | 6/1985 | Irwin et al. | 12/146 M |
| 4,669,142 | 6/1987 | Meyer | 12/146 M |
| 4,686,993 | 8/1987 | Grumbine . | |
| 4,737,032 | 4/1988 | Addleman et al. . | |
| 4,876,758 | 10/1989 | Rolloff et al. . | |
| 5,027,461 | 7/1991 | Cumberland | 12/146 M |
| 5,054,148 | 10/1991 | Grumbine . | |
| 5,088,503 | 2/1992 | Seitz | 12/142 N |
| 5,237,520 | 8/1993 | White | 12/142 N |

FOREIGN PATENT DOCUMENTS

| | | | |
|---|---|---|---|
| 1077569 | 3/1960 | Germany | 12/142 N |
| 2 308 062 | 8/1973 | Germany . | |
| 278299 | 10/1930 | Italy . | |
| 172972 | 10/1934 | Switzerland . | |

OTHER PUBLICATIONS

McAllister et al., "An interactive computer graphics system for the design of molded and orthopedic shoe lasts", Journal of Rehabilitation Research and Development, vol. 28, No. 4, 1991, pp. 39–46.

*Primary Examiner*—David P. Bryant
*Attorney, Agent, or Firm*—Brinks Hofer Gilson & Lione

[57] ABSTRACT

A method and apparatus for preparing an orthotic appliance to correct defects in a foot providing the steps of scanning a foot, creating a three-dimensional model of the corrected foot, milling a positive mold of the corrected foot, forming a uniformly thick orthotic material over the positive mold and milling out the bottom of the orthotic appliance. Also provided is a heel bisector for use in preparing an orthotic appliance.

16 Claims, 5 Drawing Sheets

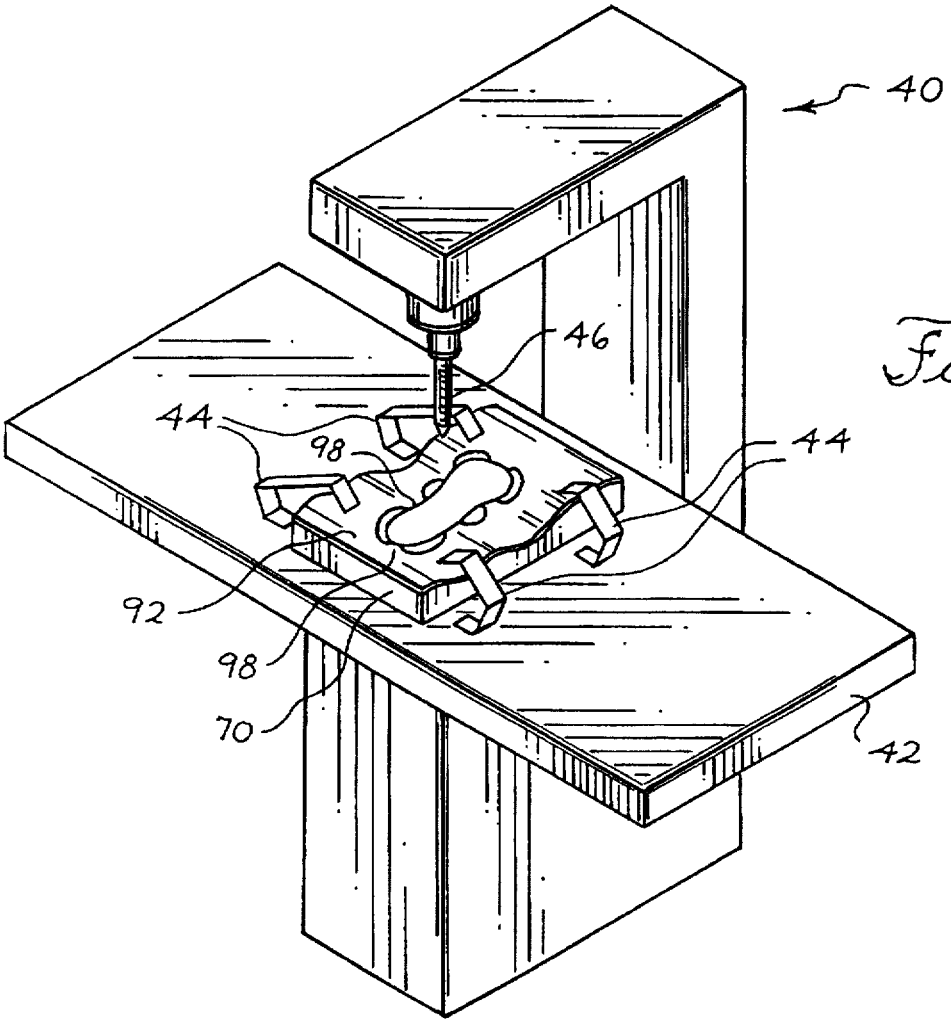
Fig. 6
Fig. 7
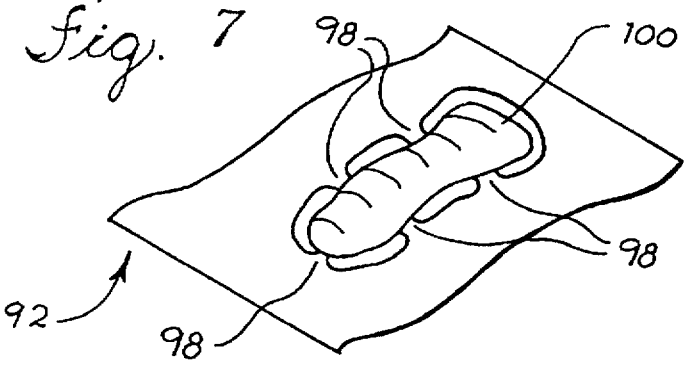
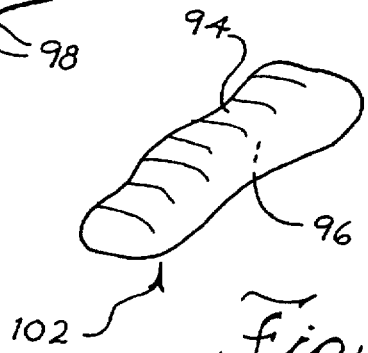
Fig. 8

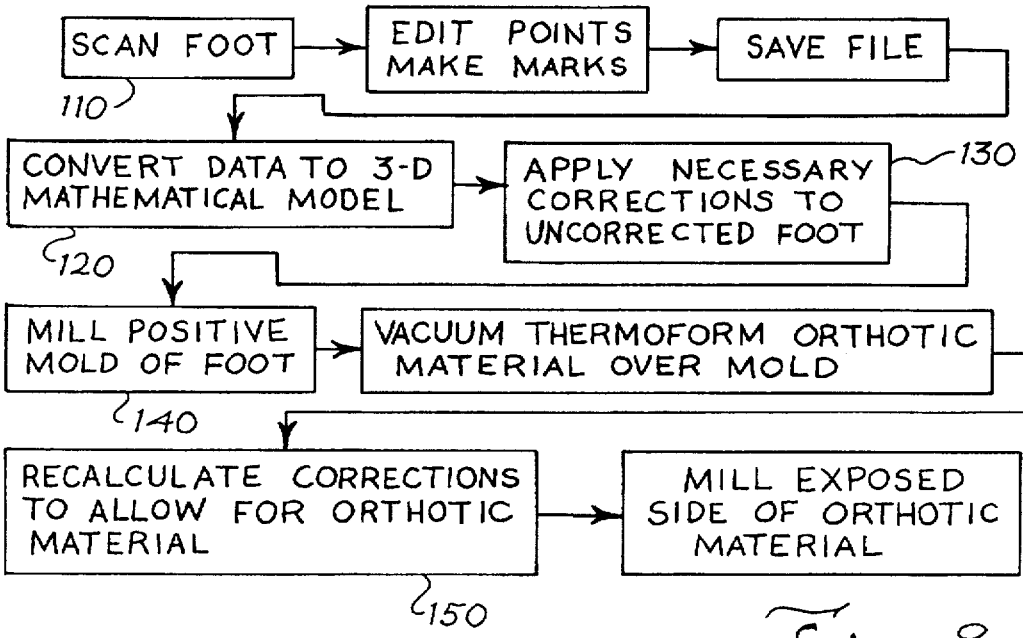
Fig. 9
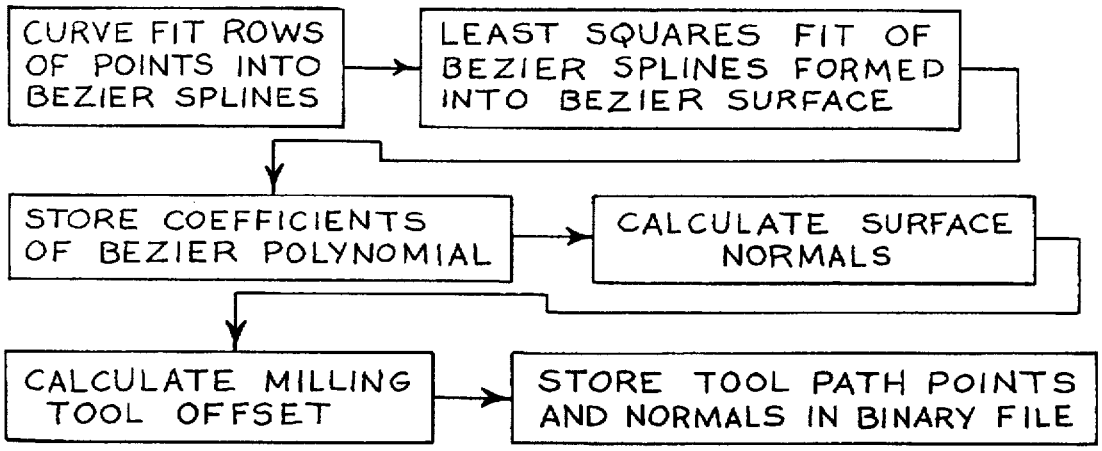
Fig. 10
Fig. 11
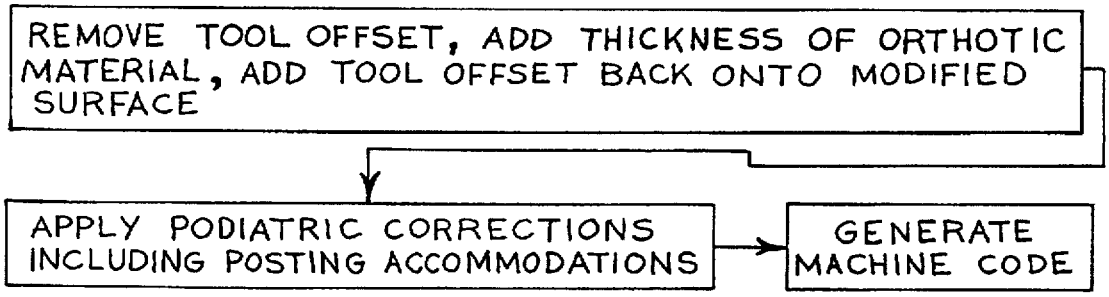

METHOD FOR PREPARING AN ORTHOTIC APPLIANCE

BACKGROUND OF THE INVENTION

This invention relates to an improved method and apparatus for making an orthotic appliance to improve performance of a person's foot.

Orthotic appliances and methods for preparing orthotic appliances have been the subject of previously issued patents. The following patents disclose various methods for preparing orthotic appliances.

| U.S. Pat. No. | Inventor |
|---|---|
| 4,454,618 | Curchod |
| 4,510,636 | Phillips |
| 4,876,758 | Rolloff et al. |
| 5,054,148 | Grumbine |

These patents disclose methods wherein the top portion of the orthotic, the portion in contact with the foot when worn, is milled by a milling device from a thick block of orthotic material.

The method of preparing an orthotic appliance can affect the material costs involved. For example, a process that requires milling one or both sides of a block of orthotic material wastes the cuttings made in shaping the orthotic. If a rectangular block of material is used as a starting point, material is wasted both in sizing the orthotic and in the cutting of the particular corrections. If sized blanks of material shaped to the person's general shoe size are used, somewhat less material is lost during cutting, but there is the added expense of stocking blanks of various shoe sizes.

Furthermore, if a particular orthotic prescription calls for a medial flange to extend up above the plane of the orthotic to add arch support, an even larger block of material is necessary. The block of material used in cutting out an orthotic with such a flange is necessarily going to be thicker in a process where both sides are milled. Because of the added cost of wasted material, it would be advantageous that a process for preparing an orthotic minimize the material cut away.

It is an object of the present invention to provide an efficient, inexpensive method for preparing an orthotic appliance while still providing an orthotic appliance with desirable properties.

SUMMARY OF THE INVENTION

According to a first aspect of this invention, a method of and an apparatus for preparing an orthotic appliance are provided. The method first includes measuring a foot topography, preferably using an optical scanning device. Next, the method includes translating the measured foot topography into a three dimensional mathematical model. After translating the topography, a computer is used to correct the foot and control a milling machine. The milling machine next cuts out a positive mold from a material. An orthotic material is then formed over the mold creating a formed side and an exposed side. Finally, the exposed side of the orthotic material is milled and becomes the bottom side of the finished orthotic appliance.

According to a second aspect of this invention, a heel bisector for use in preparing an orthotic appliance is provided. In one embodiment, the heel bisector includes a first plate section and a second plate section. Alternatively, the heel bisector may also have a joint attaching the first and second plate sections. The plate sections are constructed from an opaque material that reflects light.

BRIEF DESCRIPTION OF THE DRAWINGS

FIG. 6 is a perspective view of the materials shown in FIG. 5 and of the milling machine of FIG. 2 at a further stage of the preferred embodiment of the process of the preferred invention.

FIG. 7 is a perspective view of the milled orthotic material of the present invention.

FIG. 8 is a perspective view of the milled orthotic material shown in FIG. 7 after completion of the process of the present invention.

FIG. 9 is a flow chart of the steps performed according to the preferred embodiment of the present invention.

FIG. 10 is a flow chart of a step shown in the flow chart of FIG. 9.

FIG. 11 is a flow chart of a step shown in the flow chart of FIG. 9.

DETAILED DESCRIPTION OF THE PRESENTLY PREFERRED EMBODIMENTS

Figure 1:
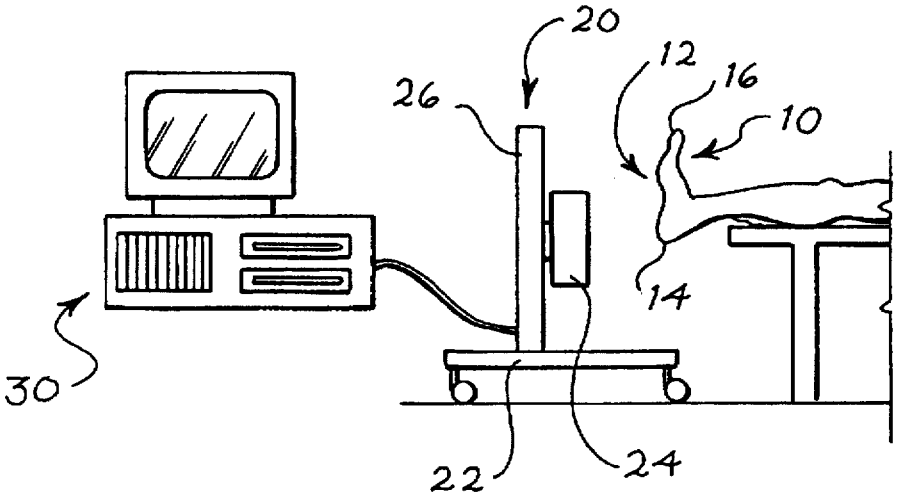
FIG. 1 is a side view of a scanner assembly in accordance with the preferred embodiment of the present invention.

Referring to FIG. 1, the preferred method of preparing an orthotic appliance begins with scanning a person's foot 10 with an optical scanner 20. The optical scanner 20 includes a base 22, a movable scanner head 24, and a scanner head transport 26. The optical scanner 20 is electrically connected to a digital computer 30. In operation, the scanner 20 is positioned such that the movable scanner head 24 is facing the bottom portion 12 of the foot 10. A podiatrist holds the foot 10 in a neutral, biomechanically correct position while the movable scanner head 24 measures the topography of the bottom portion 12 of the foot 10. To measure the topography, the movable scanner head 24 begins its scan positioned at the top of the scanner head transport 26 across from the toes 16. Emitting an optical beam, the movable scanner head 24 travels down the scanner head transport 26 substantially parallel to the bottom portion 12 of the foot 10 until the movable scanner head 24 completes its scan at the heel 14. In another embodiment, a scanner may be used where the scanner head does not move and the beam is moved.

The reflections of the optical beam off of the bottom portion 12, sides, and back of the foot 10 containing the foot topography information are next transmitted to the digital computer 30. The digital computer translates the raw information of the foot topography into a three-dimensional mathematical model. In one present embodiment, the scanning of the foot is accomplished using the method disclosed in U.S. Pat. No. 4,737,032, the entire disclosure of which is incorporated herein by reference.

Figure 2:
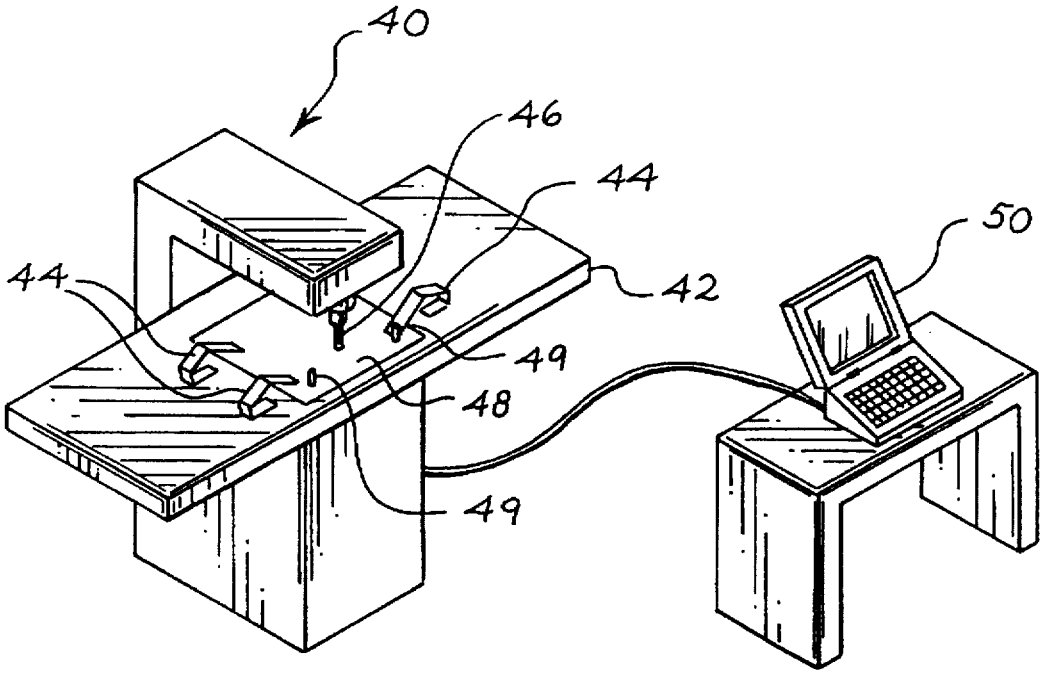
FIG. 2 is a perspective view of a milling machine for use in the process of the present invention.

Referring to FIG. 2, the preferred method of preparing an orthotic appliance utilizes a milling machine 40. The milling machine 40 includes an adjustable table 42, a cutting component 46, table clamps 44, and a removable table guide 48. The adjustable table 42 is capable of two directions of motion in the horizontal plane. The cutting component 46 is linearly movable perpendicular to the plane of the adjustable table 42. The table clamps 44 function to firmly immobilize material on the adjustable table 42. Positioned between the table clamps 44 is a removable table guide 48 having positioning posts 49. The table guide 48 and positioning posts 49 serve as a repeatable positioning apparatus to hold material for milling in a predesignated position and orientation. A milling control computer 50 controls the milling machine 40 by relaying information in three dimensions to the milling machine 40. In the present embodiment, the milling machine 40 is a three axis, knee mill that is DNC compatible, such as a Clausing CNC FV-1 milling machine. Preferably, the milling machine 40 uses a controller such as a Fagor 8020GB.

Figure 3:
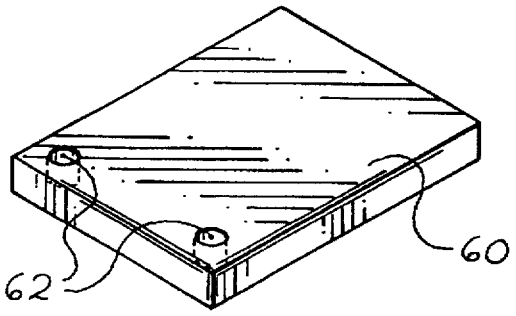
FIG. 3 is a perspective view of a block of material for use with the milling machine of FIG. 2.

As best shown in FIG. 3, a blank block of material 60 is used in the process of the present embodiment. The block of material 60 is preferably formed from a recyclable wax. The block of material 60 has a substantially uniform thickness. A preferred embodiment of the wax block is a block approximately eleven inches long by eight inches wide by two and a quarter inches thick. A plurality of positioning post holes 62 are drilled in the block of material 60. The positioning post holes 62 are designed to cooperate with the positioning posts 49 of the removable table guide 48.

Figure 4:
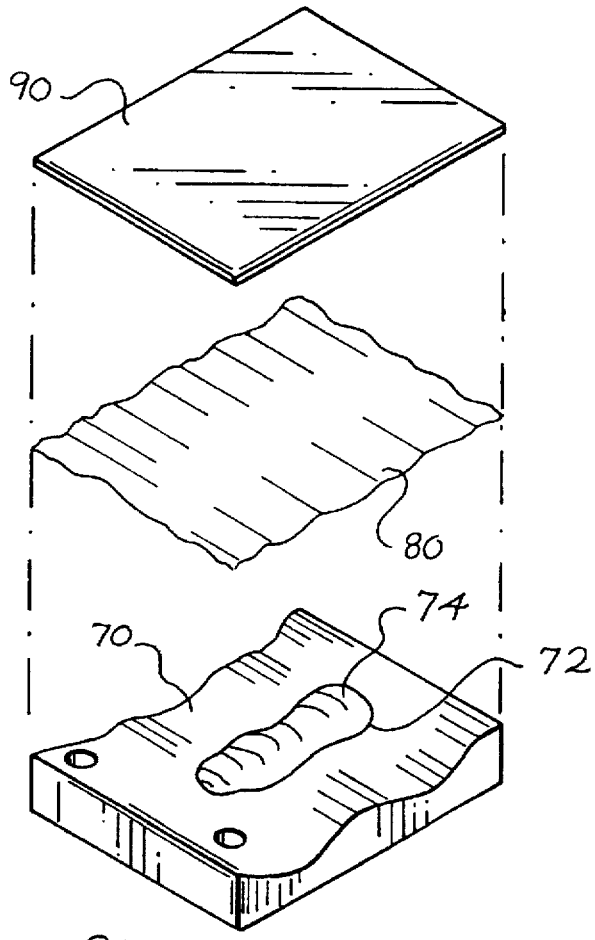
FIG. 4 is an exploded perspective view of materials used in accordance with the preferred embodiment of the present invention.

FIG. 4 shows a positive mold 70 that has been cut out of the block of material 60 by the milling machine 40. The positive mold 70 retains much of the material of the original block of material 60 and includes a positive 74 of the bottom side 12 of the person's foot 10. The positive 74 forms an outline 72 of the shape of a person's foot 10 where the positive 74 ends and the excess material from the block of material 60 begins. Also illustrated in FIG. 4 are a heat barrier 80 and an orthotic material 90. In general, the heat barrier 80 has the physical properties of being both thin and flexible as well as having low thermal conductivity and a high melting point. The heat barrier 80 is preferably a thin cloth such as a cheesecloth in the presently preferred embodiment.

The orthotic material 90 is preferably a uniform thickness. The orthotic material 90 may be a substantially flat formable sheet made of a single material or of a composite material. Alternatively, the orthotic material 90 may comprise discrete sheets of similar or differing types of material which are capable of being laminated together. The orthotic material 90, in a preferred embodiment, is a substantially rigid material, such as a laminate material, capable of supporting a person's weight with minimal deformation. A suitable type of material for the hard laminate is a plastic material. Polypropylene and polyethylene are examples of acceptable hard laminate plastic materials. In another preferred embodiment a soft laminate material may be used such as a non-plastic material. Examples of non-plastic materials suitable for use in the preferred embodiment are neoprene and cork. Alternatively, layers of both hard and soft laminate material may comprise the orthotic material. When hard and soft laminate material layers are combined, they may be secured together using chemical bonding, adhesives or simply be left to bond together by the vacuum thermoforming process described below. The above examples of plastic and non-plastic materials are not intended to be limiting because any material or materials suitable for vacuum thermoforming may be used as the orthotic material 90.

Figure 5:
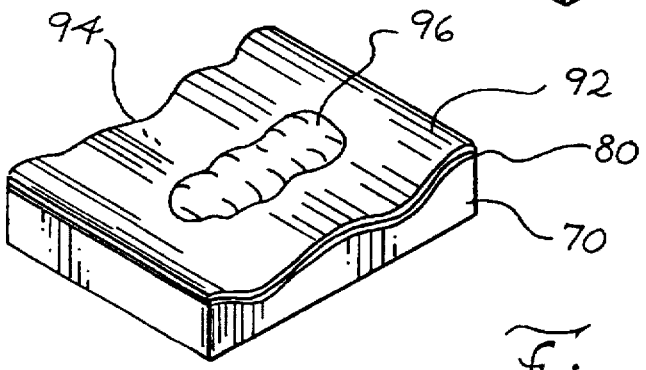
FIG. 5 is a perspective view of the materials of FIG. 4 after partial processing.

After the positive mold 72 is created using the information scanned of a person's foot 10 and after the milling machine 40 mills out a positive 74 from a block of material 60, the orthotic material 90 is placed in an oven and heated. The heated orthotic material 90, the heat barrier 80, and the mold 70 are next placed in a vacuum chamber and layered such that the positive mold 70 is on the bottom and the heat barrier 80 is between the positive mold 70 and the orthotic material 90. The vacuum chamber creates a vacuum until the orthotic material 90 deforms to conform with the shape of the positive 72 on the positive mold 70. In the presently preferred embodiment, the oven is a convection oven heated to approximately 380° F. and the vacuum chamber maintains a pressure of 26 inches of mercury. As shown in FIG. 5, during the vacuum thermoforming process the heat shield 80 protects the positive mold 70 from excessive heat and helps avoid adhesion between the positive mold 70 and the now formed orthotic material 92. The formed orthotic material 92 comprises a formed side 94 and an exposed side 96. The formed side 94 is the side facing the positive mold 70 and the exposed side 96 is the portion of the formed orthotic material 92 facing away from the positive mold 70.

FIG. 6 illustrates the next step in the process of the present embodiment. After forming the orthotic material 90, the heat barrier 80 is removed. The formed orthotic material 92 is next placed on the positive mold 70 and both are placed on the adjustable table 42 of the milling machine 40. The table clamps 44 hold the formed orthotic material 92 and positive mold 70 in place. In a preferred embodiment, the removable table guide 48 with positioning posts 49 retains the positive mold 70 and formed orthotic material 92 in a predetermined position on the adjustable table 42. Alternatively, the heat barrier 80 may be left in between the formed orthotic material 92 and the mold 70. Some orthotic materials 92 maintain better stability on the mold 70 and a more accurate shape when milled if the heat barrier 80 is not removed before milling.

Once the materials are in place on the milling machine 40, the milling control computer 50 feeds information to the milling machine 40 to mill the exposed side 96 of the formed orthotic material 92. The information sent to the milling machine 40 includes the modifications to correct problems the podiatrist has found with the foot 10 and accounts for the thickness of the orthotic material 92. The milling control computer 50 also instructs the milling machine 40 to cut along the outline 72 of the foot in the formed orthotic material 92. Material bridges 98 are left between the orthotic appliance 100 and the remainder of the formed orthotic material 92. FIG. 7 provides an illustration of the completed milling process leaving an orthotic appliance 100 attached to left-over formed orthotic material 92 by a plurality of material bridges 98. Referring to FIG. 8, the finished orthotic appliance 102 is separated from the left-over formed orthotic material 92.

FIG. 9 presents the broad steps embodied in the process of the present embodiment. First the podiatrist scans the foot for which the orthotic appliance is intended. The scan measures the topography of the bottom of the foot and displays the raw data visually, in three dimensions, for a podiatrist to edit specific points or make notations. The edited raw data is then transmitted directly to a milling laboratory or saved on a data storage medium, such as a floppy disk, and sent to the milling laboratory.

Upon receipt of the edited raw data, the milling laboratory converts the raw data into a three dimensional mathematical model of the uncorrected foot. After saving the mathematical model of the uncorrected foot, a podiatrist at the milling laboratory will make the necessary corrections to the foot and store any corrections as a separate file. The milling laboratory takes the uncorrected and corrected files and mills out a positive mold of the corrected foot. Following the milling of the positive mold, an orthotic material is formed over the mold using a vacuum thermoforming process. The vacuum thermoforming involves first heating the orthotic material in an oven and then placing the heated material in an evacuated chamber with the heat barrier and mold until the orthotic material conforms to the shape of the mold. Using the original correction file, a new set of milling instructions is created to mill the exposed side of the formed orthotic material. These instructions also take into account the thickness of the orthotic material. Finally, the milling machine is instructed to mill the exposed side of the formed orthotic material with the corrections previously calculated. The resulting orthotic appliance receives a final finishing and light sanding by hand.

Focusing on the scanning step (step 110, FIG. 9) of the present embodiment, a foot is preferably scanned as is illustrated in FIG. 1. Optically scanning a foot serves both as an expedient way and reliable way to gather information on the foot topography. Scanning a foot 10 directly saves the podiatrist and patient time over forming a plaster cast. Scanning the foot 10 directly also improves the accuracy of the gathered information because of the decreased possibility that the foot 10 will move in the short time the scan is performed.

Once the scan is complete, the information on the foot topography can be sent directly to a milling lab via a direct transmission, as with a modem, or by saving the information on a magnetic disk and forwarding the disk to the laboratory. Damage to a disk in transit is less likely than damage to a plaster cast.

An alternative embodiment, however, involves a podiatrist forming a positive or negative plaster cast of an uncorrected foot and forwarding the cast to the milling laboratory for both scanning and preparing the orthotic. In this way podiatrists without access to a scanner in the office can still benefit from the accurate repeatability of information gathered in an optical scan. Also, a podiatrist may choose to form a positive or negative plaster cast and scan the formed cast in the office. As with scanning the foot directly, the podiatrist would then forward the information of the foot topography to the milling laboratory.

As best shown in FIG. 10, the steps involved in converting the raw data into a three dimensional mathematical model (step 120, FIG. 9) are illustrated. The digital computer 30 of FIG. 1 operates to curve fit the rows of raw scanned data into Bezier splines. The Bezier splines are next subjected to a least squares fit to form a Bezier surface polynomial. The coefficients of the Bezier polynomial are stored and normals to the surface are calculated. The digital computer 30 next calculates the milling machine tool offset values to account for the size of the cutting tool 46 (FIG. 2) when milling is performed. The digital computer 30 stores the milling tool path and the normals in a binary file as a final step to complete the three dimensional mathematical model.

Step 130 in FIG. 9, showing the step of correcting the foot 10, represents where a podiatrist's decision on adjustments necessary for correcting the foot 10 enters into the process. Generally, the corrections address how the finished orthotic appliance 102 will alter the foot's 10 weight-bearing mode. A common correction made is arch adjustment. The podiatrist may, in the present embodiment, make changes on a computer screen to correct for pronation (fallen arch) or supination (foot angled such that the ankle tends outward). Additionally, material may be added or taken away on the surface of the orthotic to alter the weight-bearing load on the metatarsals. The screen of the digital computer 30 visually depicts how these adjustments affect the shape of the foot 10. Other standard adjustments are also readily made utilizing the method of the present embodiment. Regardless of the alteration desired, the podiatrist's alterations and corrections of foot defects are preferably stored as corrective algorithms, instead of individual points, in a file separate from the uncorrected three dimensional mathematical model. The uncorrected foot model is retained for future reference.

Step 140 in FIG. 9 represents the process of milling the positive mold on the milling machine 40 illustrated in FIG. 2. The milling control computer 50 generates machine code in a form proper to run the milling machine 40 by combining the corrective algorithms representative of the podiatrist's corrections and the file containing the model of the uncorrected foot. Source code for the program used to combine the information into machine code is found in Appendix A. Once the machine code is generated, the milling control computer 50 transfers the machine code to a processor on the milling machine 40 that translates the machine code into movements executable by the milling machine 40.

Following preparation and transfer of the machine code, the milling process is initiated by first obtaining positive mold material 60 (FIG. 3) and then making positioning holes 62 in the mold material 60. After preparing the positive mold material 60, a technician mounts the material 60 on the milling machine 40 (FIG. 2). The mold fits over the positioning posts 49 of the removable table guide 48. The table clamps 44 ensure the positive mold material 60 remain immobilized. As soon as the positive mold material is secure, the milling machine 40 may be activated.

Guided by the machine code generated by the milling control computer 50, the milling machine 40 operates to cut out a positive mold 70 of the earlier scanned foot 10. In addition to milling the scanned foot with the correction algorithm, the milling machine cuts the mold 70 such that all the sides of the foot are expanded from the true edges of the foot. The extra expansion included in the milling process helps to avoid a tight or pinching fit in orthotics made using stiff materials.

FIG. 4 best shows the positive 74 and how the milling process of the present embodiment wastes very little of the mold material 60 by not cutting away all of the mold material 60 outside the outline 72 of the positive 74. Some mold material 60 is milled away in the area around the positive 74 out to the edge of the positive mold 70. This material 60 is milled down to the height of the point where the outline 72 is formed. The mold material 60 that is cut away, both in the milling process and in the creation of positioning post holes 62, is collected and recycled to form more blocks of mold material 60.

In another embodiment, negative molds of the top and bottom portions of an orthotic appliance may be made using the same methods for making the positive mold 70 and restructuring the milling instructions such that negatives of the orthotic are milled. After negative molds are milled out, the orthotic appliance may then be created by forming a material inside the negative molds. A preferred method of forming the material inside the molds is by injection molding using a material suitable for injection molding. Alternatively, the negatives of the orthotic appliance may be pressed together around a formable material to form an orthotic appliance. The formable material may be one or more layers of the same or different types of material.

Following the step of milling the positive mold 70 in the presently preferred embodiment, a technician prepares the positive mold 70 for vacuum thermoforming the orthotic appliance. The orthotic material is first placed into an oven and heated. After the orthotic material is heated, the materials are assembled by placing the heat barrier 80 on top of the positive mold 70 and placing the orthotic material 90 on top of the heat barrier 80. The materials are then placed in a chamber that evacuates the air around the materials. In another embodiment, the materials may be subjected to both heating and evacuation in a single chamber.

Referring again to FIGS. 4 and 5, the vacuum thermoforming process forms the orthotic material 90 to the positive mold 70. The exposed side 96 of the formed orthotic material 92 shows a raised portion representative of the outline and contour of the foot 10. The formed side 94 of the formed orthotic material 92, which was in contact with the heat barrier 80, exactly follows the positive 74 and its partially corrected topography. In addition, the formed side 94 may also assimilate the texture of the heat barrier 80. The texture transferred to the formed side 94 improves adhesion of any covering later affixed to the finished orthotic appliance 102. An alternative to the preferred embodiment of vacuum thermoforming is using a wet mold leather process over the positive mold 70 if leather is the desired orthotic material.

The next step (step 150, FIG. 9) in the preferred embodiment is recalculating the podiatric corrections (step 130) to account for the additional thickness of the orthotic material 90 combined with the positive mold 70 measurements previously included in the milling instructions. The recalculation steps are represented in FIG. 11. Source code for the program which performs these steps on the milling control computer 50 is included in Appendix B of this specification. The steps first require taking away the milling tool offset, adding the thickness of the orthotic material 90, and recalculating the tool offset to the three dimensional mathematical model. Second, the same podiatric corrections to the mathematical model of the foot are applied and a lateral adjustment factor is calculated to add posting accommodations. Posting refers to adjustments made to the lateral angle of the foot. Finally, the recalculation is completed by generating machine code instructions for milling the exposed side 94 of the formed orthotic material 92. In another embodiment, the thickness of the heat barrier 80 is also accounted for when the heat barrier 80 is not removed prior to milling the formed orthotic material 92. The milling control computer 50 (FIG. 2) operates to calculate these changes and generate the machine code understandable by the milling machine 40. The source code for the program used to generate the machine code for the milling machine is found in Appendix C.

With the machine code prepared, a technician then removes the heat barrier 80 from between the positive mold 70 and formed orthotic material 92 and mounts the mold 70 and orthotic material 92 onto the milling machine 40. Again, the positioning posts 49 and table clamps 44 ensure accurate placement of the materials. The milling control computer 50 instructs the milling machine 40 to cut away the previously calculated portions of the exposed side 96 of the orthotic material 92 and accounts for the added thickness of the orthotic material 92 in those instructions.

In a preferred embodiment, the present method can incorporate extrinsic and intrinsic posting in an orthotic appliance. The milling machine 40 makes intrinsic posting adjustments to the heel by milling a plane in the heel part of the exposed portion 96 of the orthotic material 92. Intrinsic forefoot posting, where the positive mold 70 is milled to angle the forefoot portion of the orthotic material 92 a preset amount, is also accomplished in the present method. In either instance, the posting adjustment results in the foot resting at a biomechanically correct angle when bearing weight on the orthotic appliance 102 in a shoe.

Extrinsic posting of the rear foot or forefoot parts is another preferred embodiment. Extrinsic rear foot posting requires the additional step of adding an extrinsic posting material to the rear foot part of the exposed portion 96 of orthotic material 92. Typically, the extrinsic material is a soft, cushioning material such as neoprene and is attached with an adhesive. Once attached, the extrinsic posting material has a plane milled into it to correct the weight bearing angle of the foot 10. In contrast, extrinsic forefoot posting is accomplished by milling a plane in the exposed portion 96 of the orthotic material 92.

Extrinsic material, in a preferred embodiment, may also be attached to the exposed side 96 of the orthotic material 92 in locations other than the heel area before milling. For example, extrinsic material may be attached to the exposed side 96 in the area corresponding to the arch of a foot. As with extrinsic rear foot posting, the extrinsic material is typically a soft, cushioning material such as neoprene. Any material, however, attachable to the exposed side 96 and suitable for milling is acceptable.

The exposed side 96 becomes, in the finished orthotic appliance 102, the bottom of the orthotic. Also as part of this final milling step, the milling control computer 50 instructs the milling machine 40 to cut out segmented gaps around the perimeter of the material forming the orthotic appliance 100. The segmented gaps completely penetrate the thickness of the orthotic material 92. A plurality of material bridges 98 are left detachably connecting the orthotic appliance 100 to the unused orthotic material. The purpose of this is to stabilize the orthotic material 92 and orthotic appliance 100 on the milling machine 100 as well as provide for ease of handling. After removing the orthotic appliance 100 with attached material from the milling machine 40, as seen in FIG. 7, the orthotic appliance 100 is cut from the unused material and minor sanding and finishing is done. The resulting orthotic is best illustrated in FIG. 8. The positive mold 70 is completely recycled.

Figure 12:
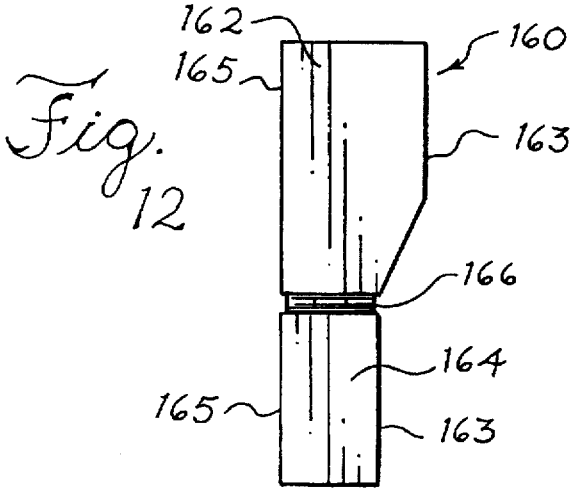
FIG. 12 is a side view of a heel bisector for use in preparing an orthotic appliance.
Figure 13:
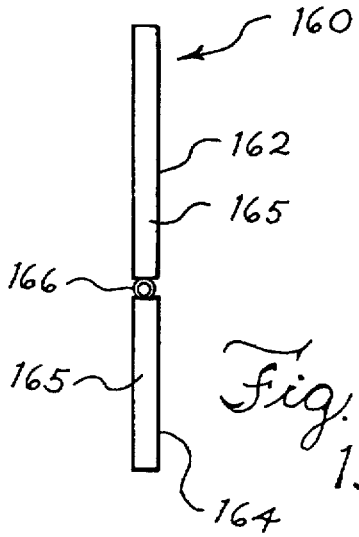
FIG. 13 is a front view of the heel bisector of FIG. 12.

FIG. 12 illustrates a heel bisector plate 160 that may be used in preparing an orthotic appliance 102. The heel bisector plate 160 includes a first plate section 162, a second plate section 164, and a joint 166 which movably connects the first and second plate sections 162, 164. Preferably, the first and second plate sections 162, 164 are constructed from a light reflecting material or painted with a light reflecting coating. Any opaque, light-colored plastic is suitable. The plate sections 162, 164 are 3 mm thick pieces of opaque white plastic in a preferred embodiment. FIG. 13 shows an edge on view of the heel bisector plate 160. The joint 166 permits the first plate section 162 to move in relation to the first plate section 164. The joint 166 is preferably a hinge or a strip of fabric attached to both plate sections 162, 164. In another preferred embodiment, the heel bisector 160 may consist of only the first and second plate sections 162, 164 without a joint 166.

Figure 14:
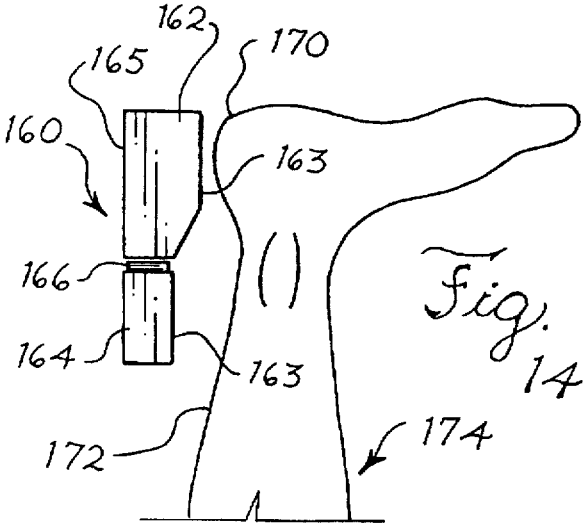
FIG. 14 is a side view of the heel bisector of FIG. 12 properly positioned on a foot.

In FIG. 14, the heel bisector plate 160 is seen mounted on the back of a leg 174. The inner edge 163 of the first plate section 162 attaches to the back of the heel 170 and the inner edge 163 of the second plate section 164 attaches to the back of the leg 174 on the lower calf 172. Prior to attaching the heel bisector 160 to the foot and leg, a podiatrist determines the proper placement.

Figure 15:
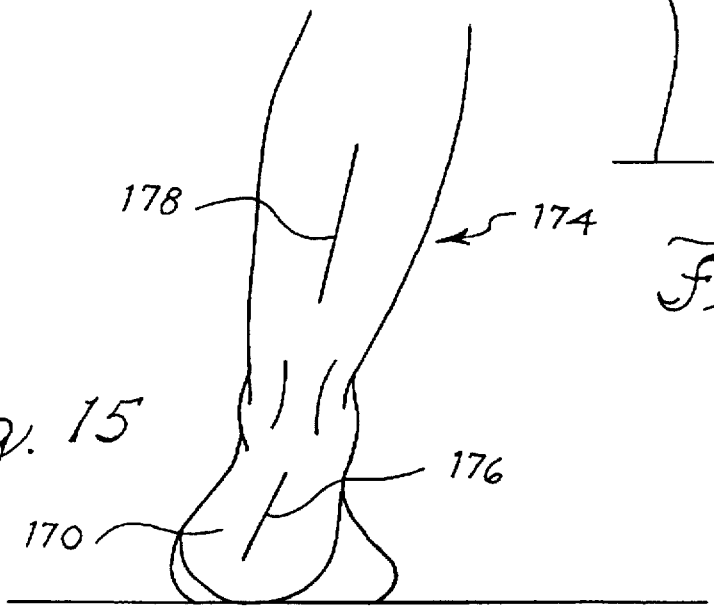
FIG. 15 is a rear view of a leg prepared to receive the heel bisector of FIG. 12.

Shown in FIG. 15, the podiatrist draws a heel line 176 and a leg line 178 as part of this determination. The heel line 176 is measured by palpating the posterior medial border and posterior lateral border of the calcaneus to find the midpoint of the posterior aspect of the heel. A line or dots are then drawn on the heel 170 along the midpoint. The leg line 178 is measured by finding the midpoint of the width of the leg 174 at the point where calf muscle begins and finding the midpoint of the leg 174 where the Achilles tendon begins to protrude just above the ankle. Two dots are then drawn, or a line between the dots are drawn, to designate the leg line 178.

In one preferred embodiment, both plate sections 162, 164 are aligned on the podiatrist's markings so that any angle created by the heel line 176 and the leg line 178 may be measured. The first plate section 162 is aligned with the heel line 176 so that it bisects the heel 170. The second plate section 164 is aligned with the leg line 178 to bisect the natural line of the leg 174. In another preferred embodiment, the plate sections 162, 164 may be aligned at predetermined angles to the heel and leg lines 176, 178. For instance, the first plate section 162 may be aligned perpendicular to the heel line 176 while the second plate section 164 is aligned parallel to the leg line 178. Each plate section 162, 164 may be aligned at any predetermined angle to its respective line 176, 178.

Both of the plate sections 162, 164 are attached preferably using adhesive tape. In other preferred embodiments, the heel bisector 160 may be attached to the leg 174 and heel 170 using clamps or may be attached to a nylon or spandex tube that may be pulled over the leg 174.

Figure 16:
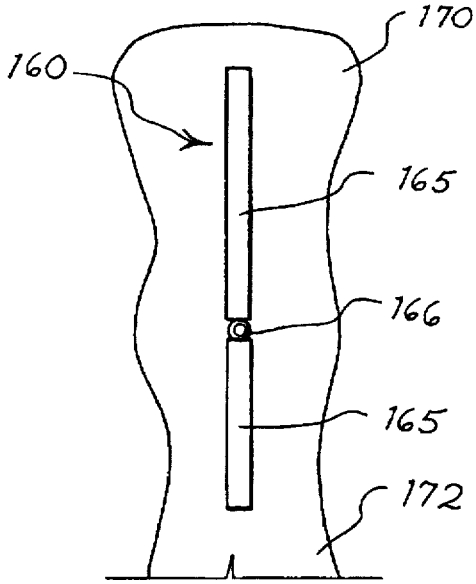
FIG. 16 is a front view of the heel bisector of FIG. 12 mounted on a properly aligned foot.

As shown in FIG. 16, the outside edges 165 of the heel bisector 160 are aligned when the heel line 176 and leg line 178 are properly aligned. Alignment of the leg line 178 and heel line 176 indicates that the sub-talar joint in the ankle is in the biomechanically correct position. On a person with an improperly aligned heel 170 and leg 174, the outside edges 165 of the first and second plate sections 162, 164 will form an angle focused at the joint 166. In a preferred embodiment of a heel bisector with no joint 166, the intersection of the lines created by extrapolating the outside edges 165 forms an angle. In a preferred embodiment of a heel bisector with first and second plate sections aligned at predetermined angles to the heel and leg lines, the heel bisector plate sections form a measurable angle from which any angle formed by the heel and leg lines may also be determined.

Scanning a foot using the heel bisector 160 permits accurate, reproducible biomechanical corrections of the foot in an orthotic appliance made according to a present embodiment. While biomechanical corrections can be made scanning a foot without the heel bisector 160, the present method of scanning with the heel bisector 169 provides automated measurement of the heel line 176 and leg line 178.

A preferred embodiment of a method for preparing an orthotic appliance is to include the heel bisector 160 when making measurements. The first step in this embodiment is attaching the heel bisector 160 to a foot. Preferably, the podiatrist tapes the heel bisector 160 to the foot and leg to attach it. Next, the foot topography is measured and the angle created by the heel bisector is measured. An optical scanner preferably scans the foot and the heel bisector 160 to make the measurements. In one embodiment, any heel bisector that is capable of forming an angle and that may be optically scanned is appropriate. After making the measurements, a computer attached to the optical scanner translates the foot topography and angle into a three dimensional mathematical model for use by the podiatrist in creating an orthotic appliance.

The heel line 176 and leg line 178, in conjunction with the foot scan are necessary for biomechanical corrections such as the intrinsic and extrinsic posting described above. Absent scanning a heel bisector 160, the heel line 176 and leg line 178 must be measured by hand or by educated guess. Including a heel bisector 160 in a scan permits for all standard biomechanical adjustments for a foot to be made in an orthotic appliance 102 constructed according to a presently preferred embodiment. These standard biomechanical measurements are set forth in the text of: Biomechanical Examination of the Foot by Merton L. Root, William P. Orien, John H. Weed, and Robert J. Hughes.

From the foregoing, an orthotic appliance and method for making an orthotic appliance has been described. The method for making the appliance is designed to improve accuracy and repeatability of producing an orthotic appliance in addition to reducing the material waste in the process. Additionally, a device for use in preparing an orthotic appliance has been described.

It is intended that the foregoing detailed description be regarded as illustrative rather than limiting. The following claims, including all equivalents, define the scope of the invention.

App. - 1

Case No. 3758/5

IN THE UNITED STATES PATENT AND TRADEMARK OFFICE
APPLICATION FOR UNITED STATES LETTERS PATENT

APPENDIX A
Source Code for Generating Machine Code Used to Mill Mold

INVENTOR(S): John Bergmann
David Parker
Thomas Sawyer

TITLE: Method and Apparatus for Preparing an Orthotic Appliance

ATTORNEYS: Frank J. Kozak
Kent E. Genin
WILLIAN BRINKS HOFER
GILSON & LIONE
P. O. Box 10395
Chicago, Illinois 60610
(312) 321-4200

App. - 2

```
/*****************************************************************************
 !      Copyright (C) BERGMANN ORTHOTIC LABORATORY 1990-1994                 !
 *****************************************************************************/
#include <stdio.h>
#include <data.h>
#include <meta.h>
#include <malloc.h>
#include <math.h>
#include <stdlib.h>
#include <io.h>
#include <fcntl.h>
#include <sys\types.h>
#include <sys\stat.h>
#include <string.h>
#include <conio.h>
#include <scrntool.h>
#include <glob1.h>
#include <graph.h>
#include <vmem.h>

#define false          0
#define true           1
#define loc(x,y)   _settextposition(x,y)


   extern FILE          *CFILE, *GCPFILE;
   extern char          CFNAME[20], AFNAME[20],BISECTION,MAKE_TABS,FOOTBED,
                        VACUUM_MOLD,ORTHOTIC_SHELL;
   extern double        CPL,*lmx,*lmy,*rmx,GcoScale,WaxThickness;
   extern int           CCNT,Spindle;
   extern float         FeedRate;
   extern float         huge *CLIP, huge *NOD_PT;


double  GetCLIPxyz(int,int);
double  GetNODExyz(int,int);


void abort_message() {
    sgr1(HI,Wt,Rd);
    _clearscreen(_GCLEARSCREEN);
    loc(12,17);
    _outtext("Corrupted toolpath file...please re-accept this file!");
    loc(14,30);
    _outtext("Hit any key to continue...");
    getch();
}


/*****************************************************************************/
/*****************************************************************************/
/***              ****              ***             ***             ****          */
/**      ******    ***    *****    ***    ****    ***    ****    ***    *******/
/**      *************    ************    ****    ***    ****    ***    *******/
/**      ****      ***    ************    ****    ***    ****    ***        ***/
```

App. - 3

```
/**     ******    ***    ************    ****    ***    ****    ***    *******/
/**     ******    ***    *****    ***    ****    ***    ****    ***    *******/
/***              ****             ***            ***            ****         */
/*****************************************************************************/
/*****************************************************************************/

void  gpoi(double tr,
           double zmax,
           int    *LINENUM,
           float  *OFS2,
           float  drop,
           char   side,
           double rf_tab,
           double ff_tab)
{
   unsigned int  FLOAT_BYTES,bytesread;
   int           ch, i, j, offset, ofscntr,fh4,num_pts,
                 tabcnt;
   double        bx, x, y, z, lastx, lasty, lastz, zplot_inc, corr_step;
   double        huge *bis_x, huge *bis_y,ofs_speed=75.0,tab_start,oldz,yline,
                 zmin;
   long          nums;
   char          path, REV, plat, end, first_point_found, do_tab,tab,start,
                 ofscut,outline;
   FILE          *f3;

   lastx = lasty = lastz = 0;
   do_tab=tab=ofscut=false;
   start=true;
   tabcnt=1;
   REV = false;
   corr_step = 0.0;
   path = false;
   ch = 0;
   end = false;
   plat = false;
   x = y = z = 0.0;
   first_point_found=false;
   zmin=150.0;
   outline=false;
   for (i = 0; i < CCNT; i++) {
      x = GetCLIPxyz(i,0);
      y = GetCLIPxyz(i,1);
      z = GetCLIPxyz(i,2);
      if (x<50.0 && x>-70.0) {
         x *= GcoScale;
         y *= GcoScale;
         z *= GcoScale;
         if (ORTHOTIC_SHELL>0.0 && ofscut && z<=0.060 && z>0.0) {
            z=zmin-0.25;
            outline=true;
         } else {
            z-=drop;
            if (!ofscut && z<zmin) zmin=z;
            if (VACUUM_MOLD) {
```

App. - 4

```
            if (start && first_point_found) {
               fprintf(GCPFILE,"Y%.3lfZ%.3lf\n",y,z); ++*LINENUM;
               start=false;
            }
         }
      }
   }
   if (!end && x==99.0) { ofscut=true; }
   if (!end && x<49.0 && z<0.025) continue;
   if (end && z<=0.060+drop && z>0.0) {
      if (FOOTBED) {
         x *= -1.0;
         x += 6.0;
      }
      end = false;
      ofscut=true;
      fprintf(GCPFILE,"N%dX%.3fF%.1f\n",*LINENUM,x,ofs_speed);
      ++*LINENUM;
      if (MAKE_TABS) tab=true;
      if (FOOTBED) {
         x -= 6.0;
         x *= -1.0;
      }
   }
   if (!end && x==99.0) {
      path = false;
      end = true;
      if (VACUUM_MOLD) {
         yline=lasty+0.05;
         if (!REV) {
            if (lastz < 1.0625) fprintf(GCPFILE,"X6.000Z1.0625\n");
            else fprintf(GCPFILE,"X6.000\n");
            ++*LINENUM;
            if (yline<=10.0) {
               fprintf(GCPFILE,"Y%.3lf\n",yline); ++*LINENUM;
            }
         }
         if (lastz < 1.0625) fprintf(GCPFILE,"X0.000Z1.0625\n");
         else fprintf(GCPFILE,"X0.000\n");
         ++*LINENUM;
         while (yline<=10.0) {
            fprintf(GCPFILE,"Y%.3lf\n",yline); ++*LINENUM;
            fprintf(GCPFILE,"X6.000\n"); ++*LINENUM;
            yline+=0.05;
            if (yline<=10.0) {
               fprintf(GCPFILE,"Y%.3lf\n",yline); ++*LINENUM;
               fprintf(GCPFILE,"X0.000\n"); ++*LINENUM;
            } else {
               break;
            }
            yline+=0.05;
         }
         fprintf(GCPFILE,"Z%.3fF80.0\n",zmax+0.3-drop);  ++*LINENUM;
         fprintf(GCPFILE,"X0.75Y0.75\n");                ++*LINENUM;
         fprintf(GCPFILE,"Z-0.25F50.0\n");               ++*LINENUM;
```

App. - 5

```
      fprintf(GCPFILE,"Z%.3fF80.0\n",zmax+0.3-drop);  +++*LINENUM;
      fprintf(GCPFILE,"X5.25Y0.75\n");                +++*LINENUM;
      fprintf(GCPFILE,"Z-0.25F50.0\n");               +++*LINENUM;
      fprintf(GCPFILE,"Z%.3fF80.0\n",zmax+0.3-drop);  +++*LINENUM;
      return;
   }
   fprintf(GCPFILE,"Z%.3fF80.0\n",zmax+0.3-drop);  +++*LINENUM;
   fprintf(GCPFILE,"X%.3f\n",lastx);               +++*LINENUM;
}
if (x < 48.0 && x>-70.0) {
   if (FOOTBED) {
      x *= -1.0;
      x += 6.0;
      if (!ofscut) {
         z *= -1.0;
         z += (zmax-drop+0.25);
      }
   }
   if (!first_point_found) {
      first_point_found=true;
      //
      //  do this on the first point of the foot
      //
      if (VACUUM_MOLD) {
         fprintf(GCPFILE,"N%dG01X0.000Y0.000F50.0S%dM03\n",
                 *LINENUM,Spindle);
         ++*LINENUM;
         fprintf(GCPFILE,"N%dZ%.3lf\n",*LINENUM,z);
         ++*LINENUM;
         yline=0.0;
         while (yline<y-0.1) {
            if (yline==0.0) fprintf(GCPFILE,"X6.000F%.1f\n",FeedRate);
            else            fprintf(GCPFILE,"X6.000\n");
            ++*LINENUM;
            yline+=0.05;
            if (yline<y-0.1) {
               fprintf(GCPFILE,"Y%.3lf\n",yline); +++*LINENUM;
            }
            fprintf(GCPFILE,"X0.000\n"); +++*LINENUM;
            yline+=0.05;
            if (yline<y-0.1) {
               fprintf(GCPFILE,"Y%.3lf\n",yline); +++*LINENUM;
            }
         }
         fprintf(GCPFILE,"Y%.3lf\n",y); ++*LINENUM;
         fprintf(GCPFILE,"X%.3lf\n",x); ++*LINENUM;

      } else {
         fprintf(GCPFILE,"N%dG01X%.3fY%.3fF50.0S%dM03\n",
                 *LINENUM,x,y,Spindle);
         ++*LINENUM;
         fprintf(GCPFILE,"N%dZ%.3f\n",*LINENUM,z);
         ++*LINENUM;
      }
      ++i;
```

App. - 6

```
    x = GetCLIPxyz(i,0)*GcoScale;
    y = GetCLIPxyz(i,1)*GcoScale;
    z = GetCLIPxyz(i,2)*GcoScale-drop;
    if (FOOTBED) {
       x *= -1.0;
       x += 6.0;
       if (!ofscut) {
          z *= -1.0;
          z += (zmax-drop+0.25);
       }
    }
    fprintf(GCPFILE,"N%dX%.3fY%.3fZ%.3fF%.1f\n",*LINENUM,x,y,z,FeedRate);
    ++*LINENUM;
    lastx=x; lasty=y; lastz=z;
    ++i;
    x = GetCLIPxyz(i,0)*GcoScale;
    y = GetCLIPxyz(i,1)*GcoScale;
    z = GetCLIPxyz(i,2)*GcoScale-drop;
    if (FOOTBED) {
       x *= -1.0;
       x += 6.0;
       if (!ofscut) {
          z *= -1.0;
          z += (zmax-drop+0.25);
       }
    }
 }
 if (!path) {
    if (tab) {
       if (do_tab) { oldz=z; z=zmax+0.25; }
    }
    if ((x!=lastx) && (y==lasty) && (z==lastz)) {
       fprintf(GCPFILE,"X%.3f\n",x);
    }
    else if ((y!=lasty) && (z == lastz) && (x == lastx)) {
       fprintf(GCPFILE,"Y%.3f\n",y);
    }
    else if ((y == lasty) && (x == lastx) && (z!=lastz)) {
       fprintf(GCPFILE,"Z%.3f\n",z);
    }
    else if ((y != lasty) && (x == lastx) && (z!=lastz)) {
       fprintf(GCPFILE,"Y%.3fZ%.3f\n",y,z);
    }
    else if ((y == lasty) && (x != lastx) && (z!=lastz)) {
       fprintf(GCPFILE,"X%.3fZ%.3f\n",x,z);
    }
    else if ((y != lasty) && (x != lastx) && (z==lastz)) {
       fprintf(GCPFILE,"X%.3fY%.3f\n",x,y);
    }
    else if (x!=lastx && y!=lasty && z!=lastz) {
       fprintf(GCPFILE,"X%.3fY%.3fZ%.3f\n",x,y,z);
    }
    else continue;
    ++*LINENUM;
```

App. - 7

```
        if (tab) {
           if (do_tab) {
              if (fabs(y-tab_start) >= (tr*2.0)+0.05) {
                 fprintf(GCPFILE,"Z%.3fF50.0\n",oldz);  ++*LINENUM;
                 z=oldz;
                 do_tab=false;
                 tabcnt++;
                 if (tabcnt==5) tab-=false;
              }
           } else {
              switch(tabcnt) {
                 case 1: if (y<=ff_tab) {
                            do_tab=true;
                            tab_start=y;
                            fprintf(GCPFILE,"Z%.3fF80.0\n",zmax+0.25);
                            ++*LINENUM;
                         }
                         break;
                 case 2: if (y<=rf_tab) {
                            do_tab=true;  tab_start=y;
                            fprintf(GCPFILE,"Z%.3fF80.0\n",zmax+0.25);
                            ++*LINENUM;
                         }
                         break;
                 case 3: if (y>=rf_tab) {
                            do_tab=true;  tab_start=y;
                            fprintf(GCPFILE,"Z%.3fF80.0\n",zmax+0.25);
                            ++*LINENUM;
                         }
                         break;
                 case 4: if (y>=ff_tab) {
                            do_tab=true;  tab_start=y;
                            fprintf(GCPFILE,"Z%.3fF80.0\n",zmax+0.25);
                            ++*LINENUM;
                         }
                         break;
              }
           }
        }
        lastx = x; lasty = y; lastz = z;
     }
  }
  else {
     if (VACUUM_MOLD) {
        if (REV) {
           if (lastz < 1.0625) fprintf(GCPFILE,"X0.000Z1.0625\n");
           else fprintf(GCPFILE,"X0.000\n");
           ++*LINENUM;
        }
        else {
           if (lastz < 1.0625) fprintf(GCPFILE,"X6.000Z1.0625\n");
           else fprintf(GCPFILE,"X6.000\n");
           ++*LINENUM;
        }
     }
```

App. - 8

```
        REV = !REV;
        start=true;
      }
    }
}

/*************************/
  void  GEN_GCODE(struct node_point_info *NODE,
                  float *OFS2,
                  char ynpump,
                  double pumpdrop,
                  double step)
/*************************/

   int          LINENUM, LN;
   double        tr, tmp, xmin, xmax, ymin, ymax, zmin, zmax, zlevel,
                 ff_tab, rf_tab;
   float        drop;

   _setvideomode(3);
   sgr1(HI,Wt,Bl);
   _clearscreen(_GCLEARSCREEN);
   loc(12,26);
   _outtext("Generating toolpath file. . .");
   LINENUM = 1;

   GCPFILE = fopen(AFNAME,"w+");

   tr   = NODE->TR;
   xmax = NODE->EXLX*GcoScale;
   xmin = NODE->EXSX*GcoScale;
   ymax = NODE->YMX*GcoScale;
   ymin = NODE->YMN*GcoScale;
   zmax = NODE->ZMX*GcoScale;
   zmin = CPL;

   ff_tab=ymax-((ymax-ymin)*0.25);
   rf_tab=ymax-((ymax-ymin)*0.75);

   /*   this is a set startup format...   */
   tmp = (xmax+xmin)/2.0;
   zlevel = WaxThickness+0.3; // =2.2;
   drop = pumpdrop*GcoScale;
   if (!(ynpump)) drop = 0.0;

   fprintf(GCPFILE,"\n");
   if (VACUUM_MOLD || MAKE_TABS) {
      fprintf(GCPFILE,"N%dG92X0.750Y0.750Z%.3lf\n",LINENUM,zlevel);
   } else {
      fprintf(GCPFILE,"N%dG92X%.3fY%.3fZ%.3f\n",LINENUM,tmp,ymin,zlevel);
   }
   ++LINENUM;

   drop += zmax-WaxThickness;
```

App. - 9

```
gpoi(tr, zmax, &LINENUM,OFS2,drop,NODE->SIDE,rf_tab,ff_tab);
if (LINENUM == -1) {
   fclose(GCPFILE);
   remove(AFNAME);
}
else {

   /*   the next four lines are shut down commands   */

   fprintf(GCPFILE,"N%dZ%.3fF180.0\n",LINENUM,WaxThickness+0.3); ++LINENUM;
   fprintf(GCPFILE,"N%dX%.3fY%.3f\n",LINENUM,tmp+step,ymin);     ++LINENUM;
   if (VACUUM_MOLD) {
      fprintf(GCPFILE,"N%dX0.750Y0.750\n",LINENUM); ++LINENUM;
   }
   fclose(GCPFILE);
}
```

App. - 10

Case No. 3758/5

IN THE UNITED STATES PATENT AND TRADEMARK OFFICE
APPLICATION FOR UNITED STATES LETTERS PATENT

APPENDIX B
Source Code for Generating Machine Code Accounting for Orthotic Material Thickness

INVENTOR(S): John Bergmann
David Parker
Thomas Sawyer

TITLE: Method and Apparatus for Preparing an Orthotic Appliance

ATTORNEYS: Frank J. Kozak
Kent E. Genin
WILLIAN BRINKS HOFER
GILSON & LIONE
P. O. Box 10395
Chicago, Illinois 60610
(312) 321-4200

App. - 11

```
/*****************************************************************************
 *      Copyright (C) 1990-1994, BERGMANN ORTHOTIC LABORATORY                 *
 *****************************************************************************/
#include <stdio.h>
#include <vmem.h>
#include <ctype.h>
#include <conio.h>

#define true   1
#define false  0


int SetRawOffset(VMEM *RAWCHUNK,VMEM *NRMCHUNK,
                 double TR,double Shell,char drop)
{
   double X,Y,Z,XR,YR,ZR;
   int    RawCnt,RawRow;
   float  huge *NOD_PT, huge *NORM;

   if (RAWCHUNK->local_ptr!=NULL) {
      VmemMakeDirty(RAWCHUNK); VmemMapOut(RAWCHUNK);
   }
   X=0.0;
   RawRow=RawCnt=0;
   NOD_PT=(float huge *)VmemMapIn(RAWCHUNK,RawRow,1);
   NORM=(float huge *)VmemMapIn(NRMCHUNK,RawRow,1);
   while (X < 98.0) {
      X = *(NOD_PT+(RawCnt*3+0));
      Y = *(NOD_PT+(RawCnt*3+1));
      Z = *(NOD_PT+(RawCnt*3+2));
      XR = *(NORM+(RawCnt*3+0));
      YR = *(NORM+(RawCnt*3+1));
      ZR = *(NORM+(RawCnt*3+2));
      ++RawCnt;
      if (X>49.0) {
         RawCnt=0;
         VmemMakeDirty(RAWCHUNK); VmemMapOut(RAWCHUNK);
                                  VmemMapOut(NRMCHUNK);
         ++RawRow;
         NOD_PT=(float huge *)VmemMapIn(RAWCHUNK,RawRow,1);
         NORM=(float huge *)VmemMapIn(NRMCHUNK,RawRow,1);
         continue;
      }
      RawCnt--;
      Z+=TR;
      // take off tool offset
      X-=(XR*TR);
      Y-=(YR*TR);
      Z-=(ZR*TR);
      // add tool offset plus shell thickness
      if (Shell<0.0) {
         //--- This is for the negative milling application
         if (Shell>-1.0) {
            //--- This adds the plaster to the cast
            X-=(XR*(TR+Shell));
```

App. - 12

```
            Y-=(YR*(TR+Shell));
            Z-=(ZR*(TR+Shell));
         } else {
            X-=(XR*TR);
            Y-=(YR*TR);
            Z-=(ZR*TR);
         }
         Z+=TR;
      } else {
         //--- This is for adding the thickness of the shell to the offset
         X+=(XR*(TR+Shell));
         Y+=(YR*(TR+Shell));
         Z+=(ZR*(TR+Shell));
         Z-=TR;

      }
      //---get it back down in the wax for just adding plaster
      if (drop) Z -= Shell;
      // modify raw data set
      *(NOD_PT+(RawCnt*3+0))=X;
      *(NOD_PT+(RawCnt*3+1))=Y;
      *(NOD_PT+(RawCnt*3+2))=Z;
      RawCnt++;
   }
   VmemMakeDirty(RAWCHUNK); VmemMapOut(RAWCHUNK);
                            VmemMapOut(NRMCHUNK);
}
```

App. - 13

Case No. 3758/5

IN THE UNITED STATES PATENT AND TRADEMARK OFFICE
APPLICATION FOR UNITED STATES LETTERS PATENT

APPENDIX C
Source Code for Generating Machine Code Used to Mill Exposed Side of Orthotic

INVENTOR(S): John Bergmann
David Parker
Thomas Sawyer

TITLE: Method and Apparatus for Preparing an Orthotic Appliance

ATTORNEYS: Frank J. Kozak
Kent E. Genin
WILLIAN BRINKS HOFER
GILSON & LIONE
P. O. Box 10395
Chicago, Illinois 60610
(312) 321-4200

App. - 14

```
/*****************************************************************************
 *          Copyright (C) 1990-1994, BERGMANN ORTHOTIC LABORATORY            *
 *****************************************************************************/
#include <stdio.h>
#include <data.h>
#include <meta.h>
#include <stdlib.h>
#include <string.h>

#include <io.h>
#include <fcntl.h>
#include <sys\types.h>
#include <sys\stat.h>

#include <conio.h>
#include <ctype.h>
#include <malloc.h>
#include <math.h>
#include <scrntool.h>
#include <glob1.h>
#include <dos.h>
#include <memory.h>
#include <time.h>
#include <graph.h>
#include <vmem.h>

#define loc(x,y)  _settextposition(x,y)
#define false     0
#define true      1


        char          GCODE,starter,flside,BISECTION,RIGHT,doright, LATPBLND,
                      ACCEPT,QUIT_CLIP,getout, goto_menu,autoread,MTD,SINKPLAT,
                      FNAME[20], NFNAME[20], BFNAME[20], CFNAME[20], AFNAME[20],
                      RTNAME[20],OPDNAME[20],CFGNAME[20],*MOL,ZPNAME[20],
                      DoPlatScore,HEELSURF,MAKE_TABS,FOOTBED,inverted,VACUUM_MOLD,
                      cbuff[80],do_slope,hexp_log,oldnamestr[60],OfsGroove,LONG;
        FILE          *CFILE, *GCPFILE,*NFILE;
        double        TEMP_LAT,BIX,BIY,*lmx,*lmy,*rmx,umtdx,umtdy,
                      lmtdx,lmtdy,pii = 3.1415965359,x_factor,y_factor,
                      cpx[4],cpy[4],*MPTS,*DPTS,WaxThickness,POC_POWER,Shell,
                      PLASTER_ADDED,ORTHOTIC_SHELL;
        MAT200x4      HT;
        MAT1x11       ROW,V1;
        int           RCNT,CCNT,action,outfsc,*pixelr,*pixels,Spindle,
                      groovec,DPCNT,MPCNT,OFSC;
        float         huge *NOD_PT, huge *CLIP, huge *NORM,
                      *HEELPOINTS, *OFS1, *OFS2,
                      LeftSlope,trad,X_MIN,Y_MIN,exsx,exlx,eylx,eysx,zmx,
                      slope,ihyy,TabVal,FeedRate, Y_MAX,
                      *outfsx, *outfsy,*groovex,*groovey,*groovez,hexp,
                      PlatScore,groovedepth,PSEUDO_BIX_PCT;
        struct        meta_raise_info  META;
        struct        attr_byte  attr;
```

App. - 15

```
        VMEM          *RAWCHUNK,*CORCHUNK;
        VMEM          *NRMCHUNK;
        VMEM          *COLUMNS,*ROWS,*HEELCHUNK;
        int           BLOCKS,NODEBLOCK,CLIPBLOCK;

void    GEN_GCODE(struct node_point_info *,float *, char,
                  double, double);
void    CORR_PREP(struct corr_exp_logicals *);
void    scanner(struct mound_pocket_info *,struct corr_exp_logicals *, int *,char *);
void    RIGHT_PREP(struct corr_exp_logicals *,struct corr_per_ang_info *);
void    zplot(float *,float *,
              int,int *,int,
              struct node_point_info *,
              struct corr_exp_logicals *,
              struct mound_pocket_info *,
              struct corr_per_ang_info *);
void    GEN_CLIP(struct corr_per_ang_info *,
                 struct corr_exp_logicals *,
                 struct node_point_info *,
                 struct mound_pocket_info *);
void    menu_corrections(struct corr_per_ang_info *,
                         struct corr_exp_logicals *,
                         struct node_point_info *,
                         struct mound_pocket_info *,
                         char *,char);
/*
void    menu(struct mound_pocket_info *,
             struct corr_per_ang_info *,
             struct corr_exp_logicals *,
             char *,char);
*/
int     auto_read_config(struct corr_exp_logicals *,
                         struct corr_per_ang_info *,
                         struct mound_pocket_info *,
                         struct node_point_info *, char);
void    auto_write_config(struct corr_exp_logicals *,
                          struct corr_per_ang_info *,
                          struct mound_pocket_info *,
                          struct node_point_info *, char);
void    CBSD(struct node_point_info *,
             struct corr_per_ang_info *,
             struct corr_exp_logicals *,
             char *,char *);
void    read_file(int,char *,char *,
                  struct node_point_info *);
void    direct(char *);
void    shell_to_dos();
int     SetRawOffset(VMEM *,VMEM *,double,double,char);
void    pauseit(double);


/* ////////////////////////// MAIN PROGRAM ////////////////////////////// */
```

App. - 16

```
main (argc,argv)
int argc;
char *argv[];

{
   char     ch,PREP,RESPONSE,beginning,exitt,clipper,do_gcode,ff_deform,scwhat,
            init=false,cfg_found;
   struct   find_t b_file;
   FILE     *descfg;
   int      i, j, num;
   float    temp;
   unsigned NUMLINES,NUMPOINTS;
   struct   node_point_info NODE;
   struct   corr_exp_logicals LOGS;
   struct   corr_per_ang_info NUMS;
   struct   mound_pocket_info MPOC;


   _setvideomode(3);
   if ((descfg = fopen("DESIGN.CFG","r")) == NULL) {
      TabVal = 0.60; groovedepth=0.14714; Spindle=3000; FeedRate=110.0;
      PlatScore=0.015877; NUMS.front = 0.0; PSEUDO_BIX_PCT=0.20;
   } else {
      fscanf(descfg,"%d\n",&i);     Spindle = i;
      fscanf(descfg,"%f\n",&temp); FeedRate = temp;
      fscanf(descfg,"%f\n",&temp); TabVal = temp;
      fscanf(descfg,"%f\n",&temp); PlatScore = temp;
      fscanf(descfg,"%f\n",&temp); NUMS.front = temp;
      fscanf(descfg,"%f\n",&temp); groovedepth = temp;
      fscanf(descfg,"%f\n",&temp); PSEUDO_BIX_PCT = temp;
      fclose(descfg);
   }
   if (Spindle<1000) {
      Spindle=3000;
      modify_cfg(Spindle,0);
   }
   if (argc < 2) {
      ORTHOTIC_SHELL=0.0;
      FOOTBED=false;
      VACUUM_MOLD=false;
   } else if (argc > 1) {
      if (argv[1][0]=='?') {
         printf("\n   Usage: SURFDES4 [-][v/i/s] [value] [?]");
         printf("\n                          -v = mill VACUUM mold base");
         printf("\n                          -i = mill footbed");
         printf("\n                          -s = mill orthotic shell");
         printf("\n                           value = orthotic shell thickness");
         printf("\n                          -p = plaster added");
         printf("\n                           value = plaster thickness");
         printf("\n                           ? = prints out this info!!\n\n");
         printf("\n");
         printf("\n          Press any key to exit...\n");
         getch();
         exit(1);
```

App. - 17

```
    }
    else if (toupper(argv[1][1])=='V') {
       VACUUM_MOLD=true;
       ORTHOTIC_SHELL=0.0;
       FOOTBED=false;
    }
    else if (toupper(argv[1][1])=='P') {
       if (argc > 2) {
          PLASTER_ADDED = atof(argv[2]);
          PLASTER_ADDED /= 25.4;
       } else {
          PLASTER_ADDED = 0.0;
       }
       VACUUM_MOLD=false;
       ORTHOTIC_SHELL=0.0;
       FOOTBED=false;
    }
    else if (toupper(argv[1][1])=='S') {
       if (argc > 2) {
          ORTHOTIC_SHELL = atof(argv[2]);
          ORTHOTIC_SHELL /= 25.4;
       } else {
          ORTHOTIC_SHELL = 0.0;
       }
       FOOTBED=false;
       VACUUM_MOLD=false;
    }
    else if (toupper(argv[1][1])=='I') {
       if (argc > 2) {
          PLASTER_ADDED = atof(argv[2]);
          PLASTER_ADDED /= 25.4;
       } else {
          PLASTER_ADDED = 0.0;
       }
       if (PLASTER_ADDED>0.0) {
          ORTHOTIC_SHELL=-(PLASTER_ADDED);
       } else {
          ORTHOTIC_SHELL=-1.0;
       }
       FOOTBED=true;
       VACUUM_MOLD=false;
    }
}
DoPlatScore=true;
hexp = 0; hexp_log = false; OfsGroove = false; SINKPLAT=false;
NUMLINES=50;   NUMPOINTS=150*3;
if ((COLUMNS=VmemAlloc(NUMLINES,NUMPOINTS*sizeof(float),VMEM_ALLOW_NO_RAM))==NULL)
   printf("\nMemory allocation problem...call Dave Parker!");
   exit(0);
}
/*
NUMLINES=25;   NUMPOINTS=200*3;
if ((HEELCHUNK=VmemAlloc(NUMLINES,NUMPOINTS*sizeof(float),VMEM_ALLOW_NO_RAM))==NUL
```

App. - 18

```
   printf("\nMemory allocation problem...call Dave Parker!");
   exit(0);
}
*/
NUMLINES=150;   NUMPOINTS=75*3;
if ((ROWS=VmemAlloc(NUMLINES,NUMPOINTS*sizeof(float),VMEM_ALLOW_NO_RAM))==NULL) {
   printf("\nMemory allocation problem...call Dave Parker!");
   exit(0);
}
NUMLINES=150;   NUMPOINTS=75*3;
if ((RAWCHUNK=VmemAlloc(NUMLINES,NUMPOINTS*sizeof(float),VMEM_ALLOW_NO_RAM))==NULL
   printf("\nMemory allocation problem...call Dave Parker!");
   exit(0);
}
if ((CORCHUNK=VmemAlloc(NUMLINES,NUMPOINTS*sizeof(float),VMEM_ALLOW_NO_RAM))==NULL
   printf("\nMemory allocation problem...call Dave Parker!");
   exit(0);
}
if ((NRMCHUNK=VmemAlloc(NUMLINES,NUMPOINTS*sizeof(float),VMEM_ALLOW_NO_RAM))==NULL
   printf("\nMemory allocation problem...call Dave Parker!");
   exit(0);
}
if ((NRMCHUNK=VmemAlloc(NUMLINES,NUMPOINTS*sizeof(float),VMEM_ALLOW_NO_RAM))==NULL
   printf("\nMemory allocation problem...call Dave Parker!");
   exit(0);
}

if ((OFS1 = (float *) malloc((250*2)*sizeof(float)))==NULL) {
   printf("\nInsufficient memory: OFS1"); getch();
}
if ((OFS2 = (float *) malloc((250*2)*sizeof(float)))==NULL) {
   printf("\nInsufficient memory: OFS2"); getch();
}
if ((MOL = (char *) malloc(5000*sizeof(char)))==NULL) {
   printf("\nInsufficient memory: MOL"); getch();
}
if ((pixels = (int *) malloc(640*sizeof(int)))==NULL) {
   printf("\nInsufficient memory: pixels"); getch();
}
if ((pixelr = (int *) malloc(480*sizeof(int)))==NULL) {
   printf("\nInsufficient memory: pixelr"); getch();
}
if ((outfsx = (float *) malloc(250*sizeof(float)))==NULL) {
   printf("\nInsufficient memory: outfsx"); getch();
}
if ((outfsy = (float *) malloc(250*sizeof(float)))==NULL) {
   printf("\nInsufficient memory: outfsy"); getch();
}
if ((groovex = (float *) malloc(250*sizeof(float)))==NULL) {
   printf("\nInsufficient memory: groovex"); getch();
```

App. - 19

```
}
if ((groovey = (float *) malloc(250*sizeof(float)))==NULL) {
   printf("\nInsufficient memory: groovey"); getch();
}
if ((groovez = (float *) malloc(250*sizeof(float)))==NULL) {
   printf("\nInsufficient memory: groovez"); getch();
}
if ((MPTS = (double *) malloc(10*3*sizeof(double)))==NULL) {
   printf("\nInsufficient memory: MPTS"); getch();
}
if ((DPTS = (double *) malloc(10*3*sizeof(double)))==NULL) {
   printf("\nInsufficient memory: DPTS"); getch();
}
if ((lmx = (double *) malloc(50*sizeof(double)))==NULL) {
   printf("\nInsufficient memory: lmx"); getch();
}
if ((lmy = (double *) malloc(50*sizeof(double)))==NULL) {
   printf("\nInsufficient memory: lmy"); getch();
}
if ((rmx = (double *) malloc(50*sizeof(double)))==NULL) {
   printf("\nInsufficient memory: rmx"); getch();
}
/*for (i=0; i<300; i++) name_str1[i] = malloc(15);*/

exitt=LONG=RIGHT=doright=false;
NUMS.DWELL_PCT=0.0;
LOGS.DWELL_FILL=false;
WaxThickness=1.9;
POC_POWER=1.0;
printf("Spindle Speed= %d\n",Spindle);
printf("Feedrate      = %f\n",FeedRate);
printf("TabVal        = %f\n",TabVal);
printf("PlatScore     = %f\n",PlatScore);
printf("Front Offset  = %f\n",NUMS.front);
printf("Groove Depth  = %f\n",groovedepth);
printf("Bisection %%   = %f\n\n",PSEUDO_BIX_PCT);
printf("Plaster added=% lf\n",PLASTER_ADDED);
printf("Shell Thick   =% lf\n",ORTHOTIC_SHELL);
printf("Footbed       =% d\n",(int)FOOTBED);
printf("Vacuum Mold   =% d\n",(int)VACUUM_MOLD);
printf("Wax Thickness=% lf\n",WaxThickness);
getch();
do {
        inverted=false;
        cpx[0]= 0.0;    cpy[0]= 0.0;
        cpx[1]= 1.0;    cpy[1]= 0.0;
        cpx[2]= 4.0;    cpy[2]= 1.0;
        cpx[3]= 6.0;    cpy[3]= 3.0;
        action=cutfsc=groovec=0;
        starter=true; do_slope=true; init=false;
        HEELSURF=false;
        if (ORTHOTIC_SHELL>0.0) MAKE_TABS=true; else MAKE_TABS=false;
        curoff();
        CBSD(&NODE,&NUMS,&LOGS,&exitt,&ff_deform);
        if (exitt) break;
```

App. - 20

```
            if (!doright) {
#if defined (NEWCORR)
               NUMS.BF=2.0;
#else
               NUMS.BF=3.0;
#endif
            }
            if (PLASTER_ADDED>0.0)
               SetRawOffset(RAWCHUNK,NRMCHUNK,NODE.TR,PLASTER_ADDED,1);
            else if (ORTHOTIC_SHELL!=0.0)
               SetRawOffset(RAWCHUNK,NRMCHUNK,NODE.TR,ORTHOTIC_SHEL_,0);
            MakeEqualRows();
            PREP = false;
            clipper = true;
            autoread = false;
            beginning = true;
            ACCEPT = false;
            getout = false;
            QUIT_CLIP = false;
            cfg_found=false;
            do {
               gtm:
               curoff();
               goto_menu = false;
               /*if (PREP) prep(&NUMS);*/
               if (beginning) cfg_found=auto_read_config(&LOGS,&NUMS,&MPOC,&NODE,0);
               else {
                  if (init) { CORR_PREP(&LOGS); init=false; }
                  /* menu(&MPOC,&NUMS,&LOGS,&clipper,ff_deform); */
                  menu_corrections(&NUMS,&LOGS,&NODE,&MPOC,&clipper,ff_deform);
                  if (getout) break;
               }
               if (clipper) GEN_CLIP(&NUMS,&LOGS,&NODE,&MPOC);
               else clipper = true;
               starter = false;
               if (getout) break;
               else if (goto_menu) {
                  PREP = true;  _setvideomode(3);
                  if (beginning) beginning = false;
                  continue;
               }
               else zplot(OFS1,OFS2,OFSC,&CCNT,RCNT,&NODE,&LOGS,&MPOC,&NUMS);
               if (!BISECTION) LOGS.BISECT = false;
               PREP = true;
               if (!QUIT_CLIP && beginning) {
                  if (doright) ;/*RIGHT_PREP(&LOGS,&NUMS);*/
                  else {
                     if ((_dos_findfirst (BFNAME, _A_NORMAL, &b_file)) != 0) {
                        num = NUMS.num_mp;
                        scanner(&MPOC,&LOGS,&num,&sowhat);
                        NUMS.num_mp = num;
                        if (action == 2) {
                           getout = true;
                           break;
```

App. - 21

```
                    }
                }
                //CORR_PREP(&LOGS);
            }
            beginning=false;
            if (!cfg_found) init=true;
        }
    } while (!QUIT_CLIP);
    if (ACCEPT) {
        do_gcode = false;
        if ((NODE.SIDE == 'R') && (BISECTION)) {
            if (BIX > ((NODE.EXSX+NODE.EXLX)/2.0)) do_gcode = true;
        }
        else if ((NODE.SIDE == 'L') && (BISECTION)) {
            if (BIX < ((NODE.EXSX+NODE.EXLX)/2.0)) do_gcode = true;
        }
        else do_gcode = true;
        if (do_gcode) {
            auto_write_config(&LOGS,&NUMS,&MPOC,&NODE,0);
            GEN_GCODE(&NODE,OFS2,
                                LOGS.PUMPS,NUMS.pump,NUMS.stepover);
        }
    }
    _setvideomode(3);
    if (getout) {
        sgr1(HI,Yl,Bk);
        RESPONSE = 'Y';
        if (RIGHT) RIGHT = false;
    }
    else if (RIGHT) RESPONSE = 'Y';
    if (!doright && RIGHT) {
        doright = true;
        BISECTION = false;
        LeftSlope = slope;
        LOGS.BISECT = false;
        LOGS.HEELPOST = false;
        if (LOGS.COE=='E')
            cfg_found=auto_read_config(&LOGS,&NUMS,&MPOC,&NODE,0);
    }
    else {
        doright = false;
        WaxThickness=1.9;
        SINKPLAT=false;
        /*hexp=0; hexp_log=false;*/
    }
    if (exists("curve.tmp\0")) remove("curve.tmp");
    VmemMakeDirty(CORCHUNK);  VmemMapOut(CORCHUNK);
    VmemMakeDirty(RAWCHUNK);  VmemMapOut(RAWCHUNK);
} while (!(toupper(RESPONSE) == 'N')) ;
VmemFree(RAWCHUNK);
VmemFree(CORCHUNK);
VmemFree(NRMCHUNK);
VmemFree(COLUMNS);
/   VmemFree(HEELCHUNK);
VmemFree(ROWS);
```

App. - 22

```
free((float *)OFS1);
free((float *)OFS2);
free((char *)MOL);
free((float *)outfsx);   free((float *)outfsy);
free((float *)groovex);  free((float *)groovey);   free((float *)groovez);
free((double *)lmx);
free((double *)rmx);
free((double *)lmy);
free((double *)DPTS);
free((double *)MPTS);
_setvideomode(3);
```

App. - 22

We claim:

1. A method of preparing an orthotic appliance for correctly supporting a foot comprising the steps of:

measuring a foot topography;

translating the foot topography into a three dimensional mathematical model;

relaying the three dimensional model and added corrections through a computer to control a milling machine;

milling a positive mold of the corrected foot topography;

forming a material over the positive mold to create a formed side and an exposed side; and milling the exposed side of the material to form a corrected bottom side of the orthotic appliance.

2. The method of claim 1 wherein the step of milling a positive mold of the corrected foot topography further comprises the steps of:

obtaining positive mold material; and making positioning holes in the positive mold material.

3. The method of claim 2 wherein the positive tmold material comprises a recyclable wax.

4. The method of claim 1 wherein the step of forming a material over the positive mold further comprises the steps of:

heating the material;

placing a heat barrier between the positive mold and the material; and creating a vacuum around the positive mold, the heat barrier, and the material until the material adapts to the topography on the positive mold.

5. The method of claim 4 wherein the heat barrier comprises a woven material.

6. The method of claim 1 wherein the step of milling the exposed side of the material further comprises the step of:

separating the orthotic appliance from unused material by milling a segmented gap around the orthotic appliance wherein the gap penetrates the material in an outline of the orthotic appliance and a plurality of material bridges remain to detachably connect the orthotic appliance to the unused material.

7. The method of claim 6 further comprising the step of:

removing the heat barrier prior to milling the exposed side of the material.

8. The method of claim 1 wherein the material has a uniform thickness before being milled.

9. The method of claim 1 wherein the step of forming a material over the positive mold further comprises the step of providing a substantially flat formable sheet as the material.

10. The method of claim 9 wherein the substantially flat formable sheet is a soft laminate of a non-plastic material.

11. The method of claim 9 wherein the substantially flat formable sheet is a hard laminate material.

12. The method of claim 11 wherein the hard laminate material is a plastic material.

13. The method of claim 1 wherein the step of milling the exposed side further comprises the steps of:

calculating a lateral adjustment factor; and milling the exposed side in accordance with the calculated lateral adjustment factor.

14. The method of claim 1 wherein the step of milling the exposed side further comprises the steps of:

adding an extrinsic posting material to said exposed side;

calculating a lateral adjustment factor; and milling the extrinsic posting material in accordance with the calculated lateral adjustment factor.

15. A method of preparing an orthotic appliance for correctly supporting a foot comprising the steps of:

measuring a foot topography;

translating the foot topography into a three dimensional mathematical model;

relaying the three dimensional model and added corrections through a computer to control a milling machine;

milling negative molds of the orthotic appliance; and forming a material inside the negative molds to create an orthotic appliance.

16. A method for preparing an orthotic appliance having the steps of measuring the topography of a foot, translating the topography into a three-dimensional mathematical model and relaying the coordinates to a computer controlled milling machine, wherein the improvement comprises the steps of:

(a) milling a positive mold of the foot topography;

(b) forming a material over the positive mold to create a formed side and an exposed side; and (c) milling the exposed side of the material to form a corrected bottom side of the orthotic appliance.

* * * * *

UNITED STATES PATENT AND TRADEMARK OFFICE

CERTIFICATE OF CORRECTION

PATENT NO. : 5,687,467
DATED : November 18, 1997
INVENTOR(S) : John Bergmann et al.

It is certified that error appears in the above-identified patent and that said Letters Patent is hereby corrected as shown below:

In the Claims

Claim 3,
Line 1, please change "tmold" to --mold--.

Claim 16,
Line 4, please change "coordinates" to --translated topography--.

Signed and Sealed this

Third Day of July, 2001

Nicholas P. Godici

*Attest:*

*Attesting Officer*

NICHOLAS P. GODICI
*Acting Director of the United States Patent and Trademark Office*